US011801680B2

(12) United States Patent
Barrese et al.

(10) Patent No.: US 11,801,680 B2
(45) Date of Patent: Oct. 31, 2023

(54) SYSTEM AND METHOD FOR COMMENCING PRINTING OPERATIONS IN AN INKJET PRINTER

(71) Applicant: Xerox Corporation, Norwalk, CT (US)

(72) Inventors: Elizabeth L. Barrese, Penfield, NY (US); Dara N. Lubin, Pittsford, NY (US); Ron E. Dufort, Rochester, NY (US); Matthew J. Ochs, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 46 days.

(21) Appl. No.: 17/648,481

(22) Filed: Jan. 20, 2022

(65) Prior Publication Data

US 2023/0226821 A1 Jul. 20, 2023

(51) Int. Cl.
*B41J 2/165* (2006.01)

(52) U.S. Cl.
CPC ..... *B41J 2/16579* (2013.01); *B41J 2/16526* (2013.01); *B41J 2/16535* (2013.01); *B41J 2002/16573* (2013.01)

(58) Field of Classification Search
CPC ..... B41J 2/165; B41J 2/1652; B41J 2/16526; B41J 2/16535; B41J 2002/16573; B41J 2/16579; B41J 29/393
USPC ..... 347/23
See application file for complete search history.

(56) References Cited

U.S. PATENT DOCUMENTS

2002/0171699 A1* 11/2002 Choi ..... B41J 29/393 347/19
2009/0244167 A1 10/2009 Saita et al.
2011/0199426 A1* 8/2011 Kuroda ..... B41J 2/16579 347/30
2020/0230952 A1 7/2020 Fehlner et al.
2021/0086536 A1 3/2021 Ramirez

* cited by examiner

*Primary Examiner* — Julian D Huffman
(74) *Attorney, Agent, or Firm* — Maginot Moore & Beck LLP

(57) ABSTRACT

A method of operating a printer iteratively performs printhead purges and test pattern analysis until either every printhead has a number of inoperative inkjets that is less than a predetermined threshold or a maximum number of iterations is reached. An error message is generated for each printhead having a number of inoperative inkjets that is greater than the predetermined threshold. The iterative performance of the printhead purges and test pattern analysis is performed automatically prior to the commencement of printing operations with the printer to remove subjective and time-consuming analysis by a printer operator.

16 Claims, 3 Drawing Sheets

SYSTEM AND METHOD FOR COMMENCING PRINTING OPERATIONS IN AN INKJET PRINTER

TECHNICAL FIELD

This disclosure relates generally to devices that produce ink images on media, and more particularly, to the image quality of the images produced by such devices.

BACKGROUND

Inkjet imaging devices, also known as inkjet printers, eject liquid ink from printheads to form images on an image receiving surface. The printheads include a plurality of inkjets that are arranged in an array. Each inkjet has a thermal or piezoelectric actuator that is coupled to a printhead controller. The printhead controller generates firing signals that correspond to digital data content corresponding to images. The actuators in the printheads respond to the firing signals by expanding into an ink chamber to eject ink drops onto an image receiving surface and form an ink image that corresponds to the digital image content used to generate the firing signals. The image receiving surface is usually a continuous web of media material or a series of media sheets.

Inkjet printers used for producing color images typically include multiple printhead assemblies. Each printhead assembly includes one or more printheads that typically eject a single color of ink. In a typical inkjet color printer, four printhead assemblies are positioned in a process direction with each printhead assembly ejecting a different color of ink. The four ink colors most frequently used are cyan, magenta, yellow, and black. The common nomenclature for such printers is CMYK color printers. Some CMYK printers have two printhead assemblies that print each color of ink. The printhead assemblies that print the same color of ink are offset from each other by one-half of the distance between adjacent inkjets in the cross-process direction to double the number of pixels per inch density of a line of the color of ink ejected by the printheads in the two assemblies. As used in this document, the term "process direction" means the direction of movement of the image receiving surface as it passes the printheads in the printer and the term "cross-process direction" means a direction that is perpendicular to the process direction in the plane of the image receiving surface.

In inkjet printers, inoperative inkjets are a known and expected problem. As used in this document, the term "inoperative inkjet" means an inkjet that does not eject any ink, ejects less ink than the firing signal should have produced, or ejects an ink drop along a path that is askew from a normal between the inkjet and the ink receiving surface opposite the inkjet. Inoperative inkjets are remediated by a process known as purging. As used in this document, the term "purging" means a procedure in which the ink in the internal reservoir of a printhead is pressurized to force liquid ink through the nozzles of the printhead so the ink flows onto the faceplate of the printhead where it is wiped away. This process is frequently successful at restoring inoperative inkjets to operational status, but sometimes multiple purge cycles have to be performed before enough inoperative inkjets are remediated to continue use of the printer. Multiple purge cycles are frequently required at the commencement of printing operations or after a printer has been idle for relatively long period of time.

Multiple purge cycles can be wasteful of ink and requires the printer to be taken out of operation. Typically, once a purge cycle is performed, the printer is operated to print a test pattern on media and an optical sensor generates image data of the printed test pattern. This data is analyzed by a controller in the printer to identify the inkjets that are remain inoperative after a purge cycle. The operator of the printer reviews the number of inoperative inkjets in each printer and subjectively evaluates whether the purge cycle was sufficiently successful to resume printing or whether another purge cycle should be performed. If another purge cycle is conducted, then the test pattern imaging and evaluation is repeated. This iterative cycle can be time consuming and wasteful of ink; however, it is necessary since streaks and other image quality problems arise. Reducing the amount of wasted ink and time consumed during multiple purge cycles would be beneficial.

SUMMARY

An inkjet printer is configured to reduce the time for performing multiple purge cycles and the amount of ink used during purging. The inkjet printer includes at least one printhead, at least one maintenance station configured to purge ink through the at least one printhead, an image sensor configured to generate image data of test patterns printed on media sheets after the media sheets pass the at least one printhead, and a controller operatively connected to the maintenance station and the image sensor. The controller is configured to iteratively operate the maintenance station to purge the at least one printhead, print a test pattern with the at least one printhead, operate the image sensor to generate image data of the printed test pattern, identify a number of inoperative inkjets using the generated image data, and compare the identified number of inoperative inkjets to a threshold until the identified number of inoperative inkjets is less than the threshold or a maximum number of iterations is reached and commence printing operations in response to the identified number of inoperative inkjets being less than the threshold.

A method of operating a color inkjet printer reduces the time for performing multiple purge cycles and the amount of ink used during purging. The method includes iteratively purging at least one printhead, printing a test pattern with the at least one printhead, generating image data of the printed test pattern, identifying a number of inoperative inkjets using the generated image data, and comparing the identified number of inoperative inkjets to a threshold until the identified number of inoperative inkjets is less than the threshold or a maximum number of iterations is reached, and commencing printing operations in response to the identified number of inoperative inkjets being less than the threshold.

BRIEF DESCRIPTION OF THE DRAWINGS

The foregoing aspects and other features of a color inkjet printer and color inkjet printer operational method that reduces the time for performing multiple purge cycles and the amount of ink used during purging are explained in the following description, taken in connection with the accompanying drawings.

DETAILED DESCRIPTION

Figure 1:
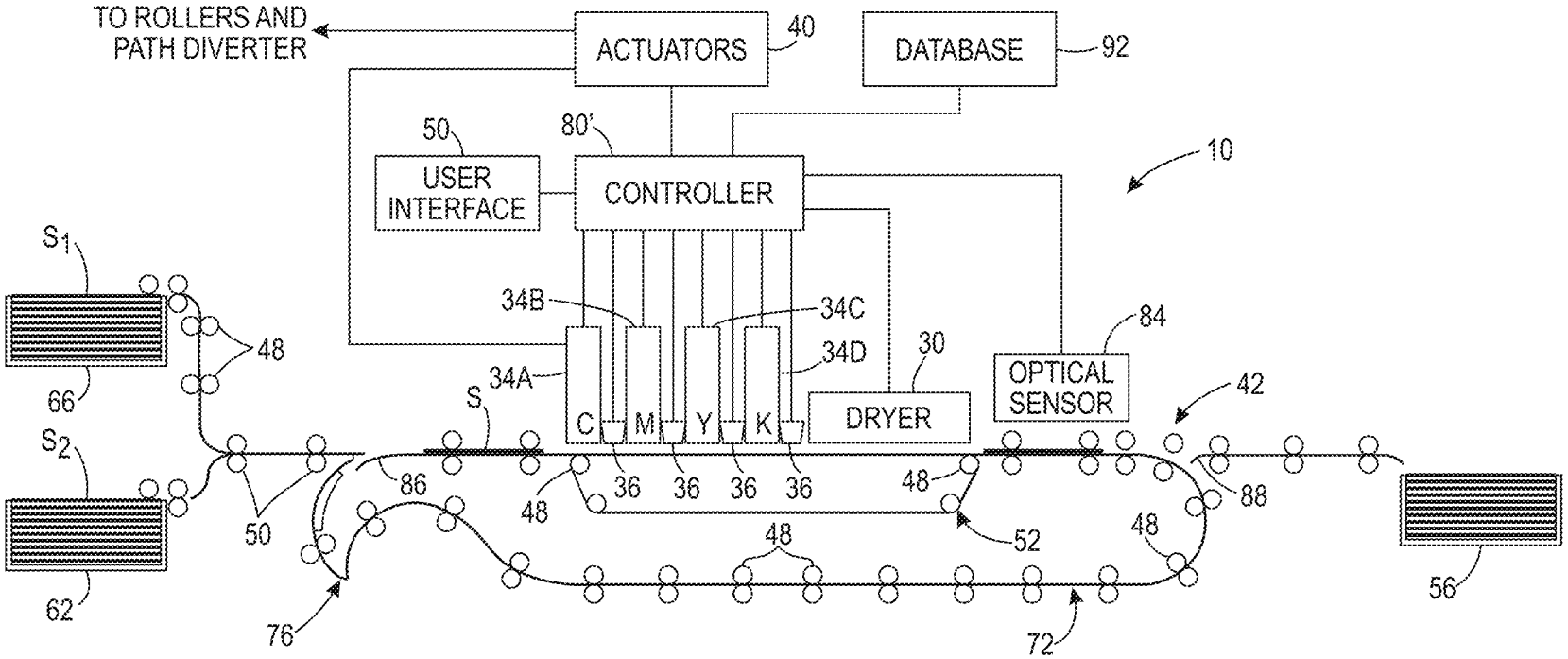
FIG. 1 is a schematic drawing of a color inkjet printer that reduces the time for performing multiple purge cycles and the amount of ink used during purging.

For a general understanding of the environment for the printer and printer operational method disclosed herein as well as the details for the printer and the printer operational method, reference is made to the drawings. In the drawings, like reference numerals have been used throughout to designate like elements. As used herein, the word "printer" encompasses any apparatus that ejects ink drops onto different types of media to form ink images.

FIG. 1 depicts a high-speed color inkjet printer 10 that reduces the time for conducting multiple purge cycles with less loss of ink. The controller 80 is configured with programmed instructions stored in a memory operatively connected to the controller that, when they are executed by the controller, reduces the number of purges conducted when an operator manually evaluates the results of a purge. The instructions, when executed by the controller identify the inoperative inkjets, any nearby inkjets that can be used to compensate for the inoperative inkjets, and other factors that an operator cannot detect. Instead, operators simply repeat the purge cycle, test pattern printing, and review of the report of the number of inoperative inkjets per printhead until the number of inoperative inkjets is less than some established norm for printing operations at the facility where the printer is installed. This repetition with a single goal in mind increases the wear on printer components, such as printhead wipers, motors, and belts Eliminating unnecessary purge cycles reduces such wear. Moreover, by configuring the controller to evaluate the results of a purge cycle, the printer is kept in operational mode with a less skilled operator. Additionally, the time between purge cycles is shortened so the printheads are used more frequently so the ambient air has less time to dry ink in the nozzles.

Figure 2:
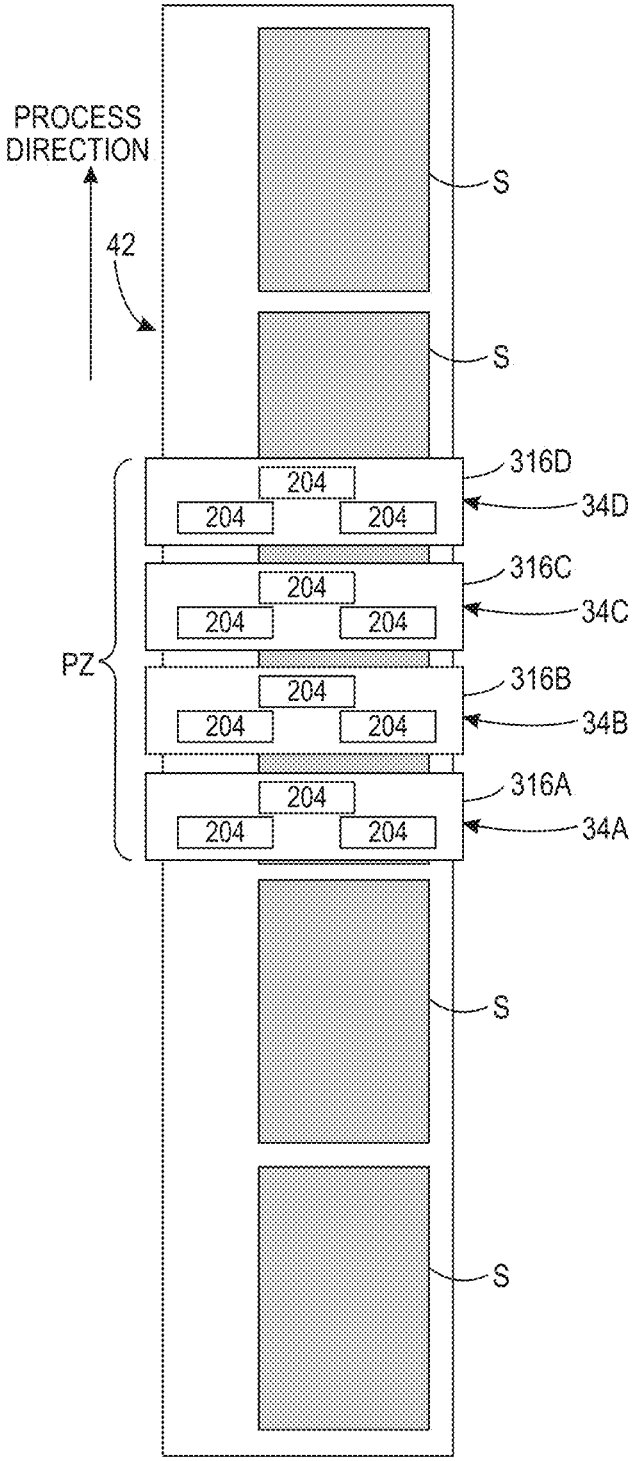
FIG. 2 depicts the print zone in the printer of FIG. 1.

As illustrated, the printer 10 is a printer that directly forms an ink image on a surface of a media sheet stripped from one of the supplies of media sheets $S_1$ or $S_2$ and the sheets S are moved through the printer 10 by the controller 80 operating one or more of the actuators 40 that are operatively connected to rollers or to at least one driving roller of conveyor 52 that comprise a portion of the media transport 42 that passes through the print zone of the printer (shown in FIG. 2). In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads within a module or between modules can also be interlaced so the density of the drops ejected by the printheads in the cross-process direction can be greater than the smallest spacing between the inkjets in a printhead in the cross-process direction. Although printer 10 is depicted with only two supplies of media sheets, the printer can be configured with three or more sheet supplies, each containing a different type or size of media.

The print zone PZ in the printer 10 of FIG. 1 is shown in FIG. 2. The print zone PZ has a length in the process direction commensurate with the distance from the first inkjets that a sheet passes in the process direction to the last inkjets that a sheet passes in the process direction and it has a width that is the maximum distance between the most outboard inkjets on opposite sides of the print zone that are directly across from one another in the cross-process direction. Each printhead module 34A, 34B, 34C, and 34D shown in FIG. 2 has three printheads 204 mounted to a printhead carrier plate 316A, 316B, 316C, and 316D, respectively.

As shown in FIG. 1, the printed image passes under an image dryer 30 after the ink image is printed on a sheet S. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air using a fan or other pressurized source of air over the ink to supplement the evaporation of the water or solvent from the ink. The air is then collected and evacuated by air returns to reduce the interference of the dryer air flow with other components in the printer.

A duplex path 72 is provided to receive a sheet from the transport system 42 after a substrate has been printed and move it by the rotation of rollers in an opposite direction to the direction of movement past the printheads. At position 76 in the duplex path 72, the substrate can be turned over so it can merge into the job stream being carried by the media transport system 42. The controller 80 is configured to flip the sheet selectively. That is, the controller 80 can operate actuators to turn the sheet over so the reverse side of the sheet can be printed or it can operate actuators so the sheet is returned to the transport path without turning over the sheet so the printed side of the sheet can be printed again. Movement of pivoting member 88 provides access to the duplex path 72. Rotation of pivoting member 88 is controlled by controller 80 selectively operating an actuator 40 operatively connected to the pivoting member 88. When pivoting member 88 is rotated counterclockwise as shown in FIG. 1, a substrate from media transport 42 is diverted to the duplex path 72. Rotating the pivoting member 88 in the clockwise direction from the diverting position closes access to the duplex path 72 so substrates on the media transport moving to the receptacle 56. Another pivoting member 86 is positioned between position 76 in the duplex path 72 and the media transport 42. When controller 80 operates an actuator to rotate pivoting member 86 in the counterclockwise direction, a substrate from the duplex path 72 merges into the job stream on media transport 42. Rotating the pivoting member 86 in the clockwise direction closes the duplex path access to the media transport 42.

As further shown in FIG. 1, the printed media sheets S not diverted to the duplex path 72 are carried by the media transport to the sheet receptacle 56 in which they are be collected. Before the printed sheets reach the receptacle 56, they pass by an optical sensor 84. The optical sensor 84 generates image data of the printed sheets and this image data is analyzed by the controller 80. The optical sensor 84 can be a digital camera, an array of LEDs and photodetectors, or other devices configured to generate image data of a passing surface. The controller 80 is configured to detect streakiness in the printed images on the media sheets of a print job. Additionally, sheets that are printed with test pattern images are inserted at intervals during the print job. These test pattern images are analyzed by the controller 80 to determine which inkjets, if any, that were operated to eject ink into the test pattern did in fact do so, and if an inkjet did eject an ink drop whether the drop had an appropriate mass and the location of the ejected drop. Any inkjet not ejecting an ink drop it was supposed to eject or ejecting a drop not having the right mass or landing at an errant position is called an inoperative inkjet in this document. The controller can store data identifying the inoperative inkjets in database 92 operatively connected to the controller. These sheets printed with the test patterns are sometimes called run-time missing inkjet (RTMJ) sheets and these sheets are discarded from the output of the print job. As already noted, the media transport also includes a duplex path that can turn a sheet over and return it to the transport prior to the printhead modules so the opposite side of the sheet can be printed. While FIG. 1 shows the printed sheets as being collected in the sheet receptacle, they can be directed to other processing stations (not shown) that perform tasks such as folding, collating, binding, and stapling of the media sheets.

The printer 10 also includes a printhead assembly maintenance station 36 for each printhead assembly. During a purge cycle, the printhead assembly is moved to the station 36 where a purge is conducted and the ink removed from the face of each printhead by a wiper. During idle periods, the printhead assemblies are moved to the stations 36 where a cap is positioned over each printhead faceplate to attenuate the drying of ink in the nozzles of the printheads. When printing operations are to be resumed, the caps are removed from the printheads and the printhead assemblies returned to their printing positions.

Operation and control of the various subsystems, components and functions of the machine or printer 10 are performed with the aid of a controller or electronic subsystem (ESS) 80. The ESS or controller 80 is operatively connected to the components of the printhead modules 34A-34D (and thus the printheads), the actuators 40, and the dryer 30. The ESS or controller 80, for example, is a self-contained computer having a central processor unit (CPU) with electronic data storage, and a display or user interface (UI) 50. The ESS or controller 80, for example, includes a sensor input and control circuit as well as a pixel placement and control circuit. In addition, the CPU reads, captures, prepares, and manages the image data flow between image input sources, such as a scanning system or an online or a work station connection (not shown), and the printhead modules 34A-34D. As such, the ESS or controller 80 is the main multi-tasking processor for operating and controlling all of the other machine subsystems and functions, including the printing process.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image content data for an image to be produced are sent to the controller 80 from either a scanning system or an online or work station connection for processing and generation of the printhead control signals output to the printhead modules 34A-34D. Along with the image content data, the controller receives print job parameters that identify the media weight, media dimensions, print speed, media type, ink area coverage to be produced on each side of each sheet, location of the image to be produced on each side of each sheet, media color, media fiber orientation for fibrous media, print zone temperature and humidity, media moisture content, and media manufacturer. As used in this document, the term "print job parameters" means non-image content data for a print job and the term "image content data" means digital data that identifies an ink image to be printed on a media sheet.

Figure 3:
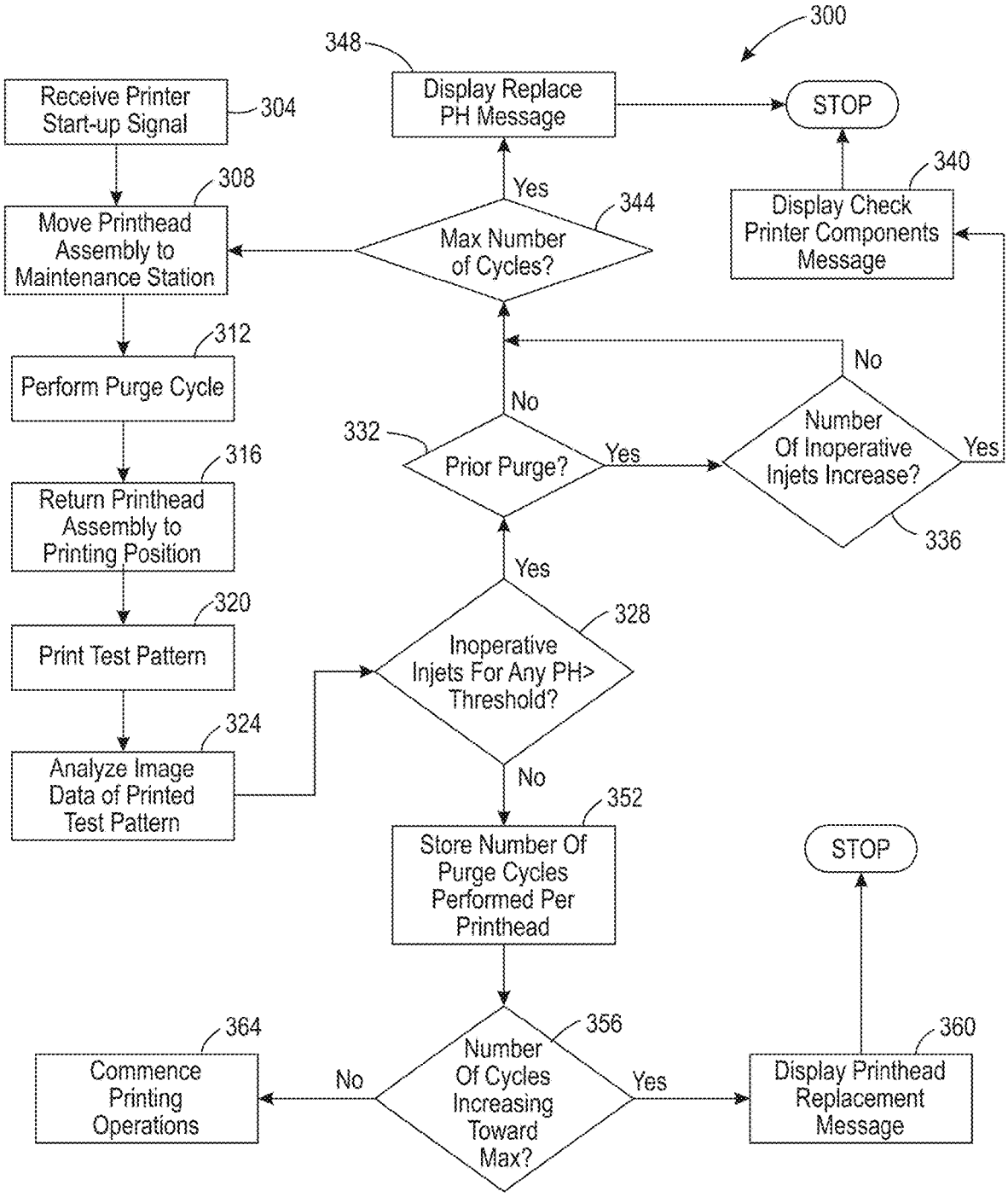
FIG. 3 is a flow diagram of a process for operating the printer of FIG. 1 to reduce the time for performing multiple purge cycles and the amount of ink used purging.

FIG. 3 depicts a flow diagram for a process 300 that operates the printer 10 to evaluate the effectiveness of multiple purge cycles more efficiently than currently possible. In the discussion below, a reference to the process 300 performing a function or action refers to the operation of a controller, such as controller 80, to execute stored program instructions to perform the function or action in association with other components in the printer. The process 300 is described as being performed with the printer 10 of FIG. 1 for illustrative purposes.

The process 300 of operating the printer 10 begins with the controller receiving a signal through the user interface 50 that the operator is commencing start-up of the printer (block 304). The process operates one or more of the actuators 40 to move the printhead assemblies to their respective maintenance stations for a purge cycle (block 308). Pressure sources are operated to urge ink through the nozzles of the printheads and the printhead faceplates are wiped by moving a wiper across the faceplates (block 312). The printhead assemblies are returned to their printing positions (block 316) and one or more test patterns are printed on media (block 320). The optical sensor generates image data of the printed test pattern(s) and the image data is analyzed to identify inoperative inkjets in each printhead (block 324). If any printhead has a number of inoperative inkjets that exceeds a predetermined threshold number of inoperative inkjets for a printhead (block 328), the process determines if a purge cycle was previously performed for that printhead (block 332). The predetermined threshold number of inoperative inkjets is a number of inoperative inkjets that indicates a purge of the printhead should be performed in an effort to reduce the number of inoperative inkjets below the predetermined threshold. If a purge was performed previously, then the process determines if the number of inoperative inkjets in the printhead has increased (block 336). If the number of inoperative inkjets for the printhead is increasing, then a message is displayed on interface 50 that the operator should check the ink supply, air in the ink supply lines, wiper blade cleanliness, and the like (block 340). The process then terminates.

If an earlier purge was conducted and the number of inoperative inkjets for the printhead is still above the predetermined threshold of inoperative inkjets but has not increased since the purge, the process determines if the number of purge cycles has reached a maximum number of purge cycle iterations for a printhead (block 344). If the maximum number of purge cycles has been reached, then a message to replace the printhead is displayed on the interface 50 (block 348) and the process terminates. Otherwise, the purge cycle and test pattern analysis is repeated (blocks 308-324) until a maximum number of cycles is performed on the printhead (block 344) or the number of inoperative inkjets falls below the predetermined threshold number of inoperative inkjets (block 328). If all of the printheads have a number of inoperative inkjets that is below the predetermined threshold, the process stores in database 92 the number of purges performed in the current cycle of purging and test pattern analysis for each printhead with a timestamp (block 352). Prior to storing the number of purges performed, the current number of purges is compared to the number of purges stored in the database for the previous purge and test pattern analysis cycle. If the number of purges performed in the current cycle of purges and test pattern analysis is greater than the previously stored number and the current number of inoperative inkjets for the printhead is within about 90% of the predetermined threshold (block 356), then a message is displayed to replace the printhead (block 360). Otherwise, printing operations can commence (block 364). In one embodiment, each printhead has 5544 inkjets and the predetermined threshold is about 1% of the number of inkjets so 55 inkjets is the predetermined threshold. If the number of purges is increasing and the number of inoperable inkjets reaches about 90% of the predetermined threshold or 50 inkjets, then a message is replace the printhead is displayed.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for operating an inkjet printer comprising:

purging at least one printhead, printing a test pattern with the at least one printhead, generating image data of the printed test pattern, identifying a number of inoperative inkjets using the generated image data, comparing the identified number of inoperative inkjets to a threshold to determine whether the identified number of inoperative inkjets is greater than the threshold, and iteratively performing the purging, printing, generating, identifying, and comparing steps until the identified number of inoperative inkjets is less than or equal to the threshold or a maximum number of iterations is reached, the purging of the at least one printhead being performed by operating at least one pressure source to urge ink through nozzles of at least one printhead and operating at least one actuator to move a wiper to wipe a faceplate of the at least one printhead;

after each iteration, determining whether the number of inoperative inkjets for the at least one printhead has increased from a number of inoperative inkjets identified following a previously performed purge during the iterations for the at least one printhead and terminating printing operations when the number of inoperative inkjets has increased from the number of inoperative inkjets identified during a previous iteration; and commencing printing operations in response to the identified number of inoperative inkjets being less than or equal to the threshold.

2. The method of claim 1 further comprising:

storing in a memory the number of purges performed for the at least one printhead to reduce the number of inoperative inkjets for the at least one printhead below the threshold.

3. The method of claim 2 further comprising:

storing the number of purges performed for the at least one printhead in the memory with a timestamp.

4. The method of claim 3 further comprising:

comparing the number of purges performed for the at least one printhead during a current cycle of purges and test pattern analysis with the number of purges previously stored for the at least one printhead; and commencing printing operations in response to the number of purges performed in the current cycle being less than the previously stored number of purges.

5. The method of claim 4 further comprising:

commencing printing operations in response to the number of purges performed in the current cycle being greater than the previously stored number of purges but less than the maximum number of iterations.

6. The method of claim 5 further comprising:

terminating printing operations in response to the number of purges performed in the current cycle being greater than the previously stored number of purges and the number of inoperative inkjets is greater than 90% of the threshold.

7. The method of claim 6 wherein the threshold is one percent of a number of inkjets in a single printhead.

8. The method of claim 1 further comprising:

terminating printing operations in response to the maximum number of iterations being reached.

9. An inkjet printer comprising:

at least one printhead;

at least one maintenance station configured to purge ink through the at least one printhead, the at least one maintenance station having at least one wiper, at least one actuator configured to move the at least one wiper across a faceplate of the at least one printhead, and at least one pressure source configured to urge ink through nozzles of the at least one printhead;

an image sensor configured to generate image data of test patterns printed on media sheets after the media sheets pass the at least one printhead; and a controller operatively connected to the maintenance station and the image sensor, the controller being configured to:

operate the maintenance station to purge the at least one printhead by operating the at least one pressure source in the maintenance station to urge ink through nozzles of the at least one printhead and operating the at least one actuator to move the at least one wiper across the faceplate of the at least one printhead, print a test pattern with the at least one printhead, operate the image sensor to generate image data of the printed test pattern, identify a number of inoperative inkjets using the generated image data, and compare the identified number of inoperative inkjets to a threshold to determine whether the identified number of inoperative inkjets is greater than the threshold, and iteratively performing the purging, printing, generating, identifying, and comparing steps until the identified number of inoperative inkjets is less than the threshold or a maximum number of iterations is reached;

determine whether the number of inoperative inkjets for the at least one printhead has increased from a number of inoperative inkjets identified following a previously performed purge during the iterations for the at least one printhead and terminate printing operations when the number of inoperative inkjets has increased from the number of inoperative inkjets identified during a previous iteration; and commence printing operations in response to the identified number of inoperative inkjets being less than the threshold.

10. The inkjet printer of claim 9 further comprising;

a memory; and the controller being operatively connected to the memory, the controller being further configured to:

store in the memory the number of purges performed for the at least one printhead before the number of inoperative inkjets for the at least one printhead goes below the threshold.

11. The inkjet printer of claim 10, the controller being further configured to:

store the number of purges performed for the at least one printhead in the memory with a timestamp.

12. The inkjet printer of claim 11, the controller being further configured to:

compare the number of purges performed for the at least one printhead during a current cycle of purges and test pattern analysis with the number of purges previously stored for the at least one printhead; and commence printing operations in response to the number of purges performed in the current cycle being less than the previously stored number of purges.

13. The inkjet printer of claim 12, the controller being further configured to:

commence printing operations in response to the number of purges performed in the current cycle being greater than the previously stored number of purges and the number of inoperative inkjets is less than 90% of the threshold.

14. The inkjet printer of claim 13, the controller being further configured to:

terminate printing operations in response to the number of purges performed in the current cycle being greater than the previously stored number of purges.

15. The inkjet printer of claim 14 wherein the threshold is one percent of a number of inkjets in a single printhead.

16. The inkjet printer of claim 9, the controller being further configured to:

terminate printing operations in response to the maximum number of iterations being reached.

* * * * *